US005307529A

United States Patent [19]

Wang

[11] Patent Number: 5,307,529

[45] Date of Patent: May 3, 1994

[54] MASSAGE BUBBLE GENERATING INFLATABLE ARTICLE

[75] Inventor: Cheng-Chung Wang, Taipei, Taiwan

[73] Assignee: Team Worldwide Corporation, Taipei, Taiwan

[21] Appl. No.: 741,365

[22] Filed: Aug. 7, 1991

[51] Int. Cl.[5] ..... A61H 33/02

[52] U.S. Cl. ..... 4/585; 4/541.5

[58] Field of Search ..... 4/585, 588, 541.3, 541.4, 4/541.5

[56] References Cited

U.S. PATENT DOCUMENTS

| | | | |
|---|---|---|---|
| 2,504,646 | 4/1950 | Burrow | 4/585 X |
| 4,744,112 | 5/1988 | Keesling, Jr. | 4/585 |
| 4,756,032 | 7/1988 | Wang | 4/588 X |
| 4,964,183 | 10/1990 | LaForce, Jr. | 4/585 X |
| 4,986,781 | 1/1991 | Smith | 4/541.3 X |
| 5,095,559 | 3/1992 | Liljegren et al. | 4/541.5 X |

*Primary Examiner*—Thomas B. Will
*Assistant Examiner*—W. Morris Worth
*Attorney, Agent, or Firm*—Sughrue, Mion, Zinn, Macpeak & Seas

[57] ABSTRACT

An inflatable article for a person to rest thereupon and which is capable of generating massage bubbles for the person when the inflatable article is immersed in water. The inflatable article is composed of at least three layers of PVC sheets which include a first layer of PVC sheet, a second layer of PVC sheet, and a third layer of PVC sheet. The first layer and the second layer are heat-sealed together at a plurality of upper joints so as to form at least one inflatable air chambers between the first layer and the second layer, with a plurality of upper and lower vent holes being, respectively, formed in those areas of the heat-bonded first layer and second layer other than the air chamber so as to communicate the water around the inflatable article with the region below the second layer. The second layer and the third layer are heat-sealed together at a plurality of lower joints so as to form at least one air passages which communicate with the water through the vent holes and are connected to an apparatus for supplying pressurized air so that pressurized air thereof may be fed through the air passage and the vent holes into the water to form bubbles in the water.

12 Claims, 12 Drawing Sheets

MASSAGE BUBBLE GENERATING INFLATABLE ARTICLE

FIELD AND BACKGROUND OF THE INVENTION

The present invention relates to an inflatable article for a person to rest thereupon, and more particularly, to an inflatable article which is capable of generating, either by use of pumping means or self-acting means, massage bubbles for the person when the inflatable article is immersed in water.

As is well known, air bubbles generated within a tub or a mattress can result in massage effect to the tub or mattress user, and recover the bodily fatigue of the user. For this end, tubs or mattress of fixed types capable of generating air bubbles have been constructed. As for inflatable tub or mattress, in order to generate air bubbles, it has been proposed to install separate air hoses formed therein with air vents as well as necessary fittings at the bottom of the inflatable tub or mattress. However, on account of the existence of the air hoses and fittings, it is impossible to fold this kind of inflatable tub or mattress, even deflated, to a very compact size. Consequently, this kind of inflatable tub or mattress suffers from the drawbacks of inconvenience in transportation due to its bulky volume and higher cost in production due to the necessity of preparing and installing extra air hoses and fittings.

SUMMARY OF THE INVENTION

It is therefore the primary object of the present invention to provide a massage bubble generating inflatable article upon which a person can lie down and take a rest and which is capable of generating bubbles when the inflatable article is immersed in water for effectively massaging the body of the person so as to recover the fatigue of the person.

Another object of the present invention is to provide a massage bubble generating inflatable article which can be folded to a very compact size so as to facilitate transportation, and which can be produced at lower cost.

The present invention provides a massage bubble generating inflatable articles, which comprises at least a first layer of PVC sheet, a second layer of PVC sheet, and a third layer of PVC sheet. The first layer of PVC sheet and the second layer of PVC sheet are heat-sealed together at a plurality of upper joints so as to form at least one inflatable upper air chamber between the first layer of PVC sheet and the second layer of PVC sheet. The second layer of PVC sheet and the third layer of PVC sheet are heat-sealed together at least long their circumferences so as to form, between the second layer of PVC sheet and the third layer of PVC sheet, at least one air passage which is connected to the pressurized air supplying means, thus allowing pressurized air supplied by the pressurized air supplying means to enter the recess of the tub through the air passage and the lower and upper vent holes.

In a first application, the inflatable article is utilized as the base section of a tub. Using the tub, a user can take a bath and at the same time enjoy the massage effects produced by the bubbles.

In a second application, the inflatable article is utilized as a floating mattress which is commonly used for a person to rest thereupon to take a sun bath on the water of a swimming pool. Using the floating mattress, the person can exercise his/her body and simultaneously has his/her body massaged by the bubbles produced by the motion of the exercise.

BRIEF DESCRIPTION OF THE DRAWINGS

The present invention can be more fully understood by a reading to the following detailed description and with references made to the accompanying figures, wherein.

DETAILED DESCRIPTION OF THE PREFERRED EMBODIMENTS

The inflatable article according to the present invention will be hereinafter illustrated and described by way of two exemplary applications, the first is a tub and the second is a floating mattress.

Figure 1:
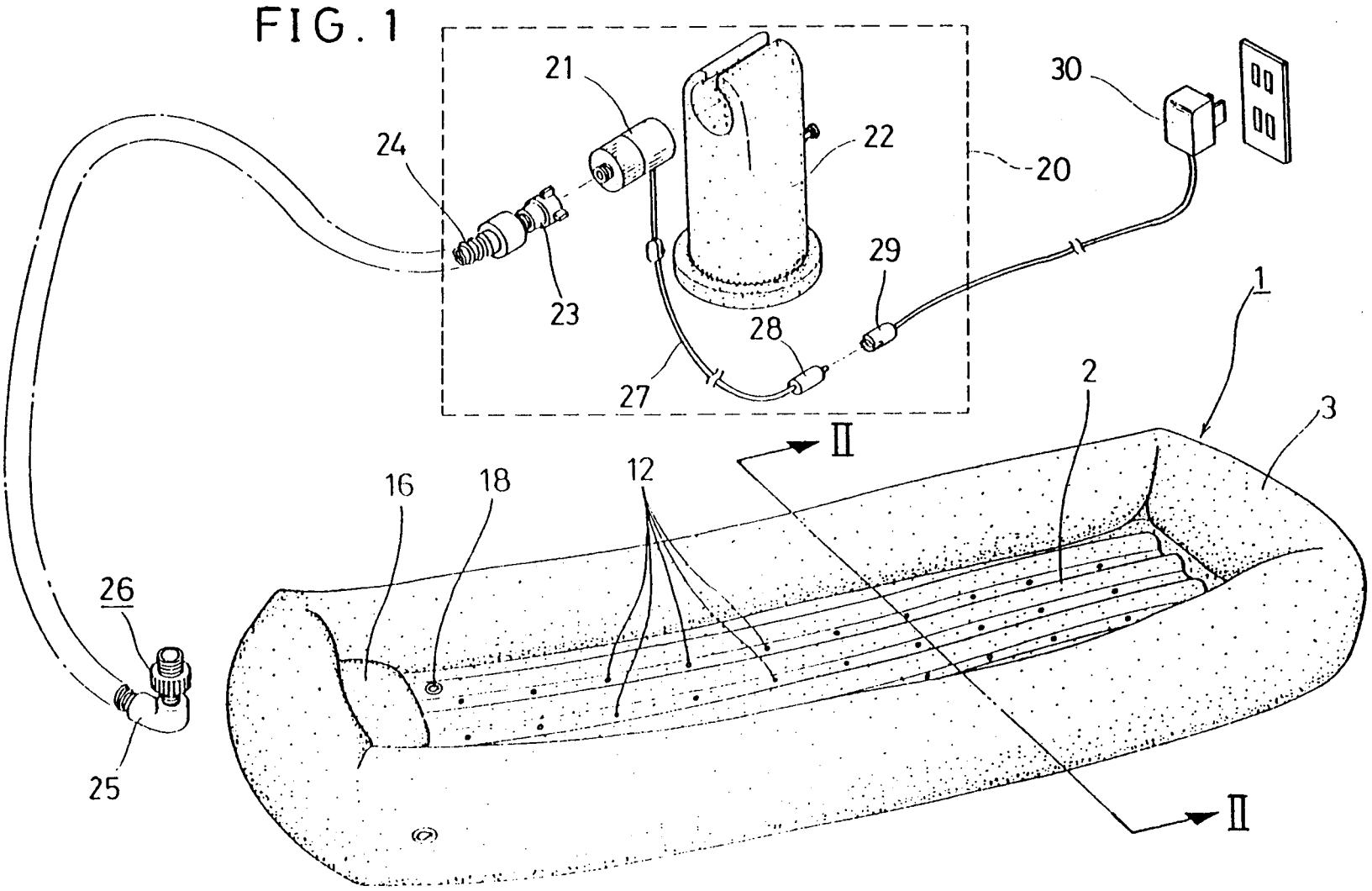
FIG. 1 is an exploded perspective view of a tub utilizing an inflatable article of the present invention.
Figure 2:
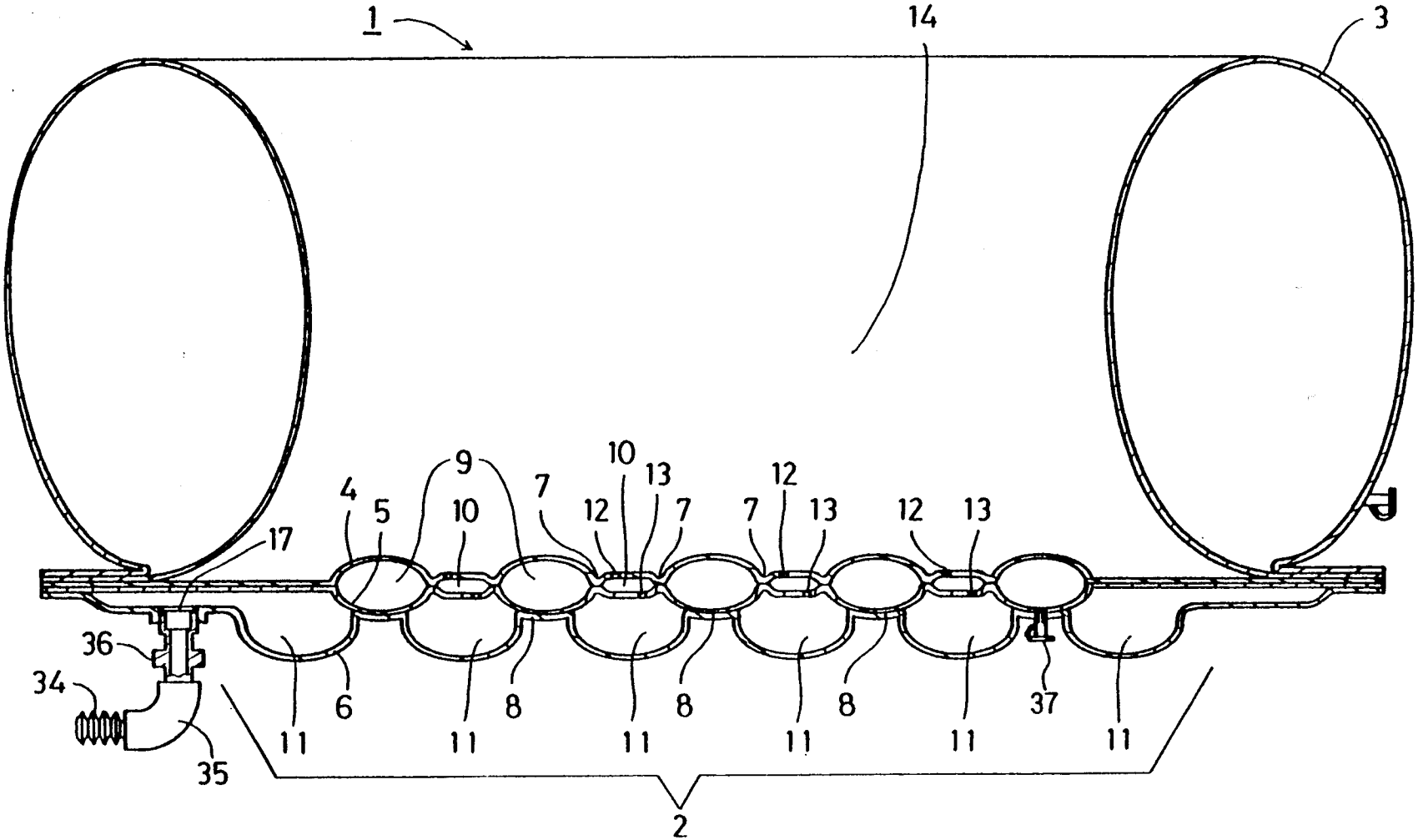
FIG. 2 is a sectional view taken along line II—II in FIG. 1.

Referring to FIGS. 1 and 2, the inflatable article of the present invention is utilized as a comprising part of a tub 1. The tub 1 comprises a base section 2 and an inflatable surrounding section or wall 3 heat-sealed to the peripheries of the base section 2 so as to form with the base section a recess or cavity 14 for receiving water, and a pressurized air supplying means 20 for supplying pressurized air to the tub 1. The inflatable article of the present invention is used here as the base section 2.

As shown in FIG. 1, the pressurized air supplying means comprises 20 a DC blower 21, a supporting seat 22 for supporting the blower 21, an air hose 24, a first connector 23 interconnecting blower 21 and air hose 24, a 90° elbow 25 and a second connector 26 interconnecting the air hose 24 and the base section 2 of the tub 1, an electrical power cord 27, a pair of power source electrical connectors 28 and 29 installed intermediate the power cord 27, and a AC/DC adaptor 30.

Figure 3:
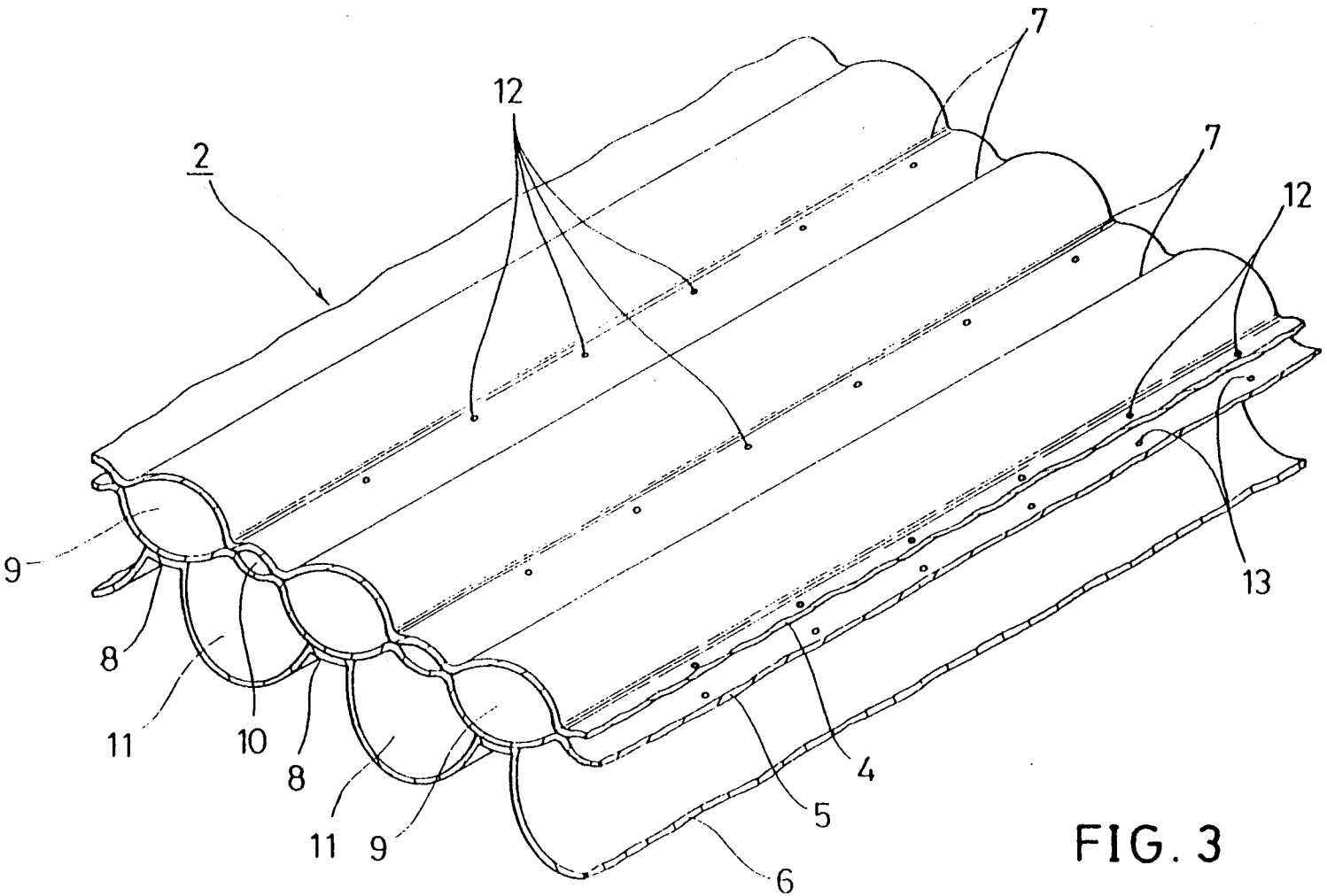
FIG. 3 is a fragmentary enlarged view of the base section of the tub shown in FIG. 1.

In the application shown in FIGS. 1, 2, and 3, the base section 2, i.e. the inflatable article, of the tub 1 is formed by a first layer of PVC sheet 4, a second layer of PVC sheet 5 and a third layer of PVC sheet 6. The first layer of PVC sheet 4 and the second layer of PVC sheet 5 are heat-sealed together at a plurality of upper joints 7 which are substantially straight and extending parallel to one another so as to divide the space between the first layer of PVC sheet 4 and the second layer of PVC sheet 5 into a plurality of parallel inflatable air chambers 9 for supporting the weight of a user. Also formed at an appropriate location between first layer 4 and second layer 5, is an upper air compartment 16 which communicates with all air chambers 9 to facilitate the inflation of air chambers 9. Upon air inflation, via air blower 21, air pressurization thereof is maintained by closing air closure plug 37, FIG. 2. The upper air compartment 16 also acts as a pillow for the user to rest his/her head thereupon. In addition, a plurality of upper vent holes 12 and lower vent holes 13 are, respectively, formed in those areas of the heat-bonded first layer of PVC sheet 4 and the second layer of PVC sheet 5 other than the air chambers 9. As shown in FIG. 2, each upper vent hole 12 does not vertically align with any lower vent holes 13. In the areas provided with vent holes 12 and 13, narrow vent passages 10 are left between the first layer of PVC sheet 4 and the second layer of PVC sheet 5 away from each other in these areas. Otherwise, vent passages 10 are closed due to the action of the weight of water in tub 1 so as to prohibit reverse flow of water into vent passages 10, thus keeping the air passage dry.

The second layer of PVC sheet 5 and the third layer of PVC sheet 6 are heat-sealed together at a plurality of lower joints 8 which are substantially straight and which extends parallel to one another so as to divide the space between the second layer of PVC sheet 5 and the third layer of PVC sheet 6 into a plurality of separate air passages 11 each of which communicates with the recess 14 of tub 1 through vent holes 12, 13. Also formed at an appropriate location between the second layer of PVC sheet 5 and the third layer of PVC sheet 6 is a lower air compartment (not shown) which communicates with all air passages 11 and which is connected to the air hose 34 through an inflation port 17 provided at proper location in the base section 2 so that pressurized air supplied by the blower 21 may be fed, through the air hose 34, an inflation port 17, the lower air compartment, the air passages 11, and the vent holes 12, 13 etc. into the cavity 14 of the tub 1 to produce rising air bubbles within the water filled into the recess 14. A drain valve 18 is provided in base section 2 for draining purpose.

Figure 4:
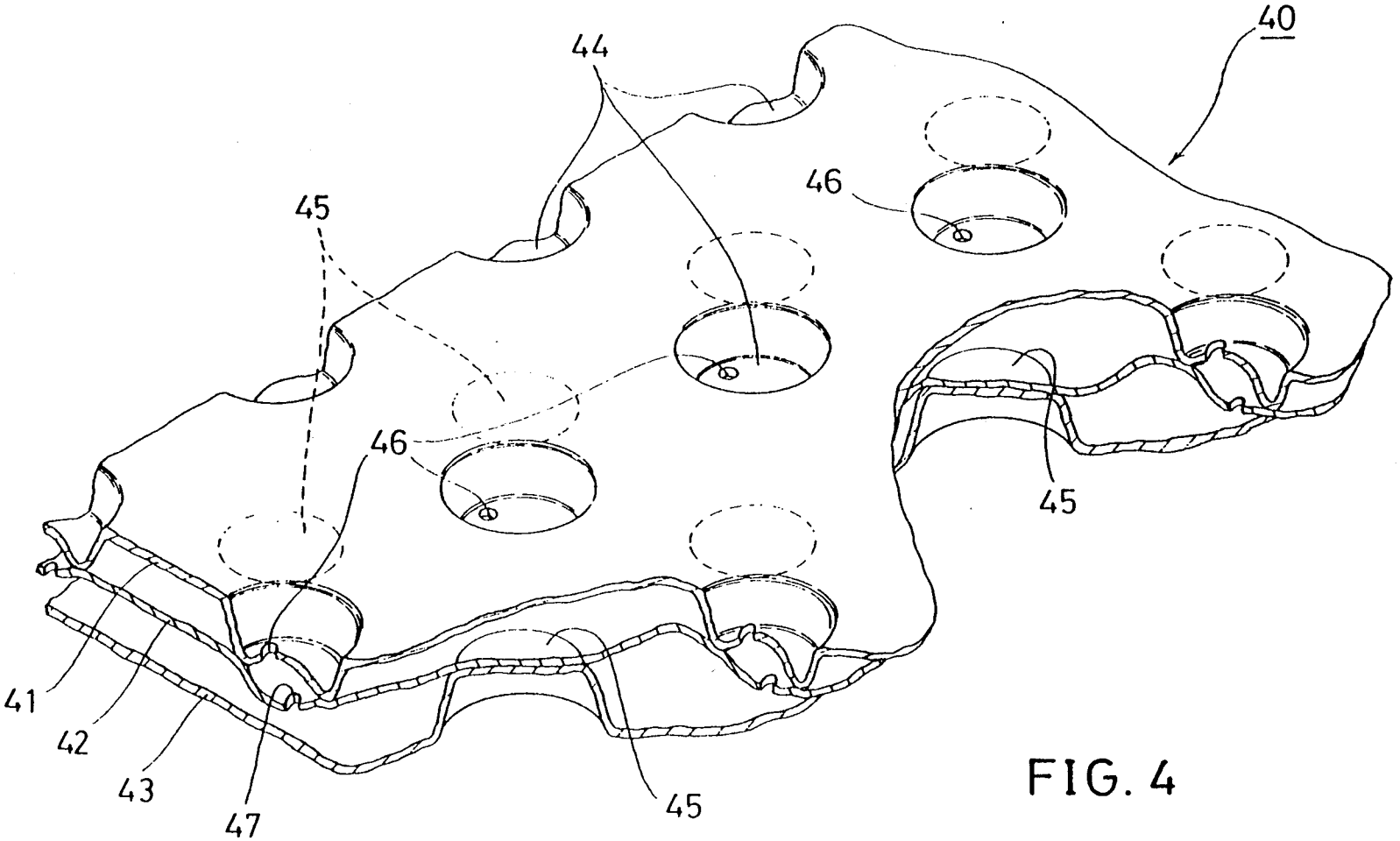
FIG. 4 is a fragmentary enlarged view of the base section of another type of tub.

FIG. 4 is a fragmentary enlarged view of the base section 40 of another type of inflatable article in accordance with this invention, which can be alternatively used in constructing the tub 1. Base section 40 is also formed by a first layer of PVC sheet 41, a second layer of PVC sheet 42 and a third layer of PVC sheet 43. The first layer of PVC sheet 41 and the second layer of PVC sheet 42 are heat-sealed together at a plurality of separate upper joints 44. Similarly, the second layer of PVC sheet 42 and the third layer of PVC sheet 43 are heat-sealed together at a plurality of separate lower joints 45. Observing from top of base section 40, upper joints 44 and lower joints 45 are alternately arranged so as to avoid blockage of the passage of pressurized air supplied by pressurized air supplying means. Upper and lower joints 44 and 45 may take annular shape of a circle or an ellipse. In addition, upper and lower vent holes 46 and 47 are, respectively, provided in the first layer of PVC sheet 41 and the second layer of PVC sheet 42 within each area surrounded by an annular upper joint 44 in a manner similar to that shown in FIG. 2.

Constructions of the base sections of the tubs utilizing the inflatable article according to the present invention are not restricted to those shown in FIGS. 1–4. FIGS. 5A–5E are, respectively, sectional views of five other types of inflatable articles which can be used alternatively as the base section of the tub 1.

Figure 5A:
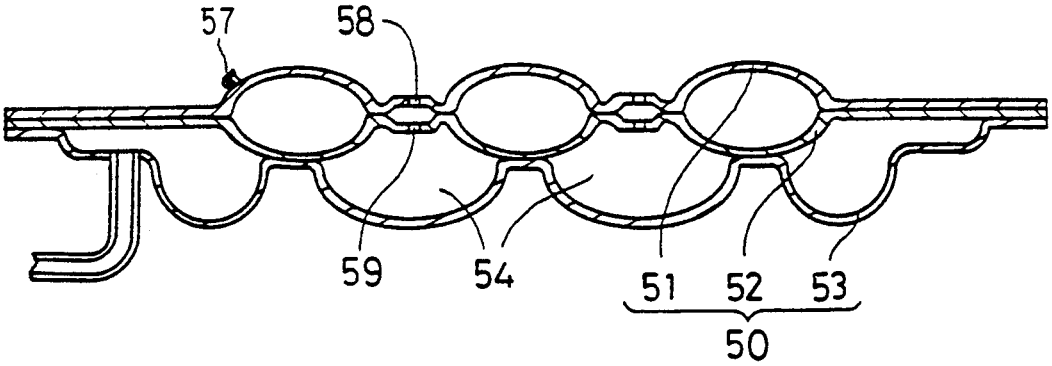
FIGS. 5A–5E are, respectively, sectional views of five types of inflatable articles according to the present invention.

FIG. 5A shows an inflatable article 50, formed by a first layer of PVC sheet 51, a second layer of PVC sheet 52 and a third layer of PVC sheet 53, which is substantially of the same structure as the inflatable article 2 shown in FIG. 2 except that each upper vent hole 58 provided in the first layer of PVC sheet 51 vertically aligns with a lower vent hole 59 provided in the second layer of PVC sheet 52.

Figure 5B:
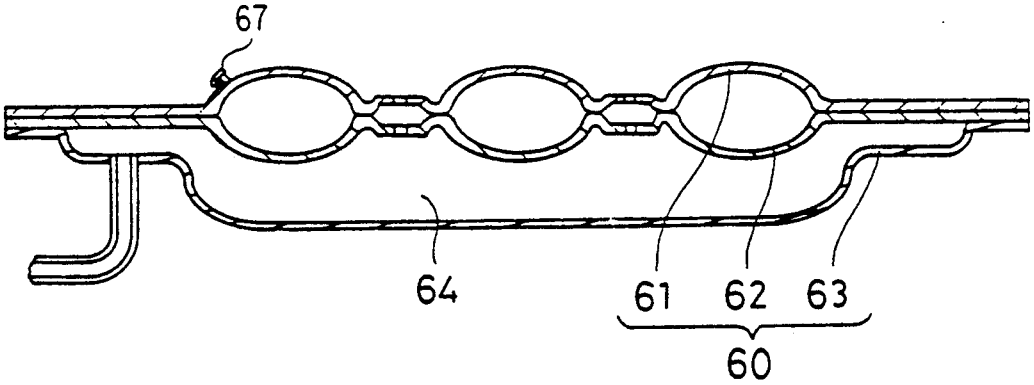

FIG. 5B shows an inflatable article 60 quite similar to inflatable article 50 except that its third layer of PVC sheet 63 is heat-sealed to its second layer of PVC sheet 62 only along the peripheries of the second layer of PVC sheet 62 and the third layer of PVC sheet 63 so as to form a large air passage 64, instead of a plurality of smaller air passages, between the second layer of PVC sheet 62 and the third layer of PVC sheet 63.

Figure 5C:
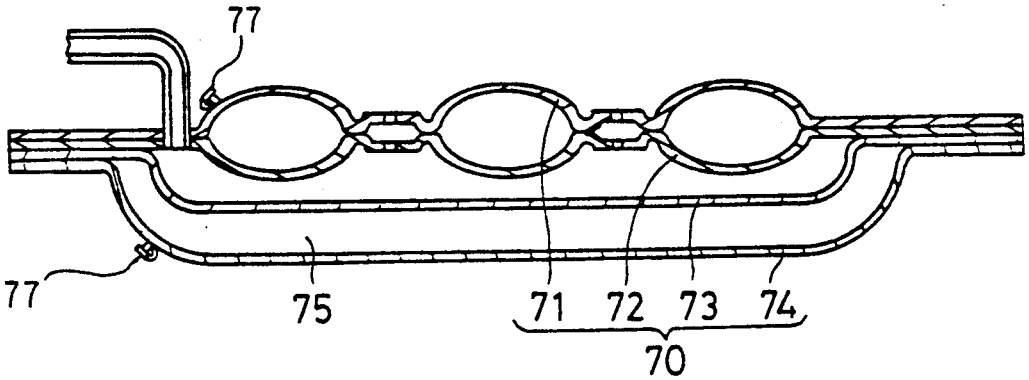

FIG. 5C shows an inflatable article 70 formed by further heat-sealing a fourth layer of PVC sheet 74 to the underside of the inflatable article 60 illustrated in FIG. 5B so as to form a large air chamber 75 between the third layer of PVC sheet 73 and the fourth layer of PVC sheet 74.

Figure 5D:
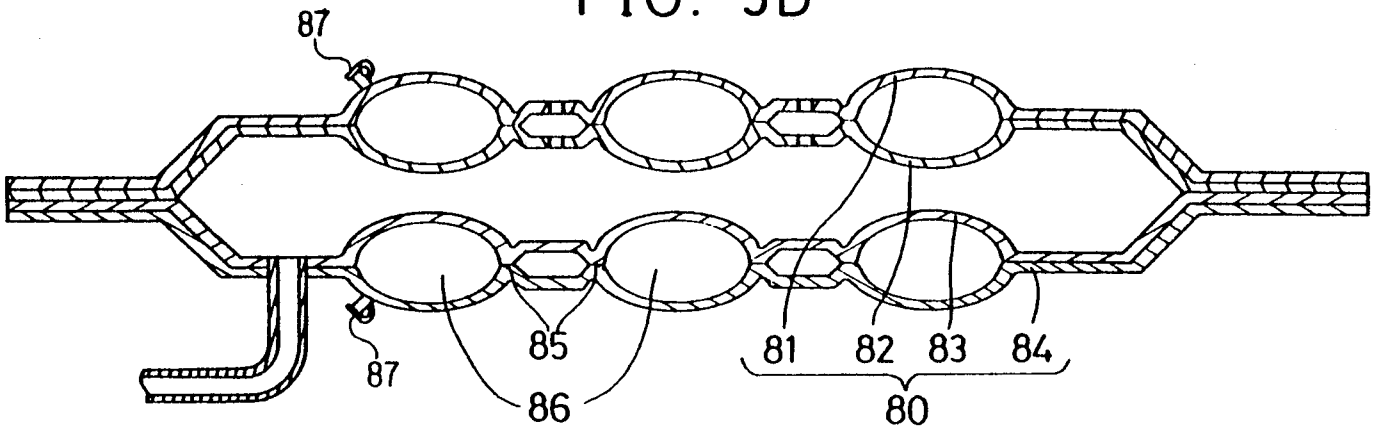

FIG. 5D shows an inflatable article 80 which has a structure similar to the inflatable article 70 illustrated in FIG. 5C except that its third layer of PVC sheet 83 and fourth layer of PVC sheet 84 are heat-sealed together at a plurality of joints 85 so as to further form a plurality of lower air chambers 86.

Figure 5E:
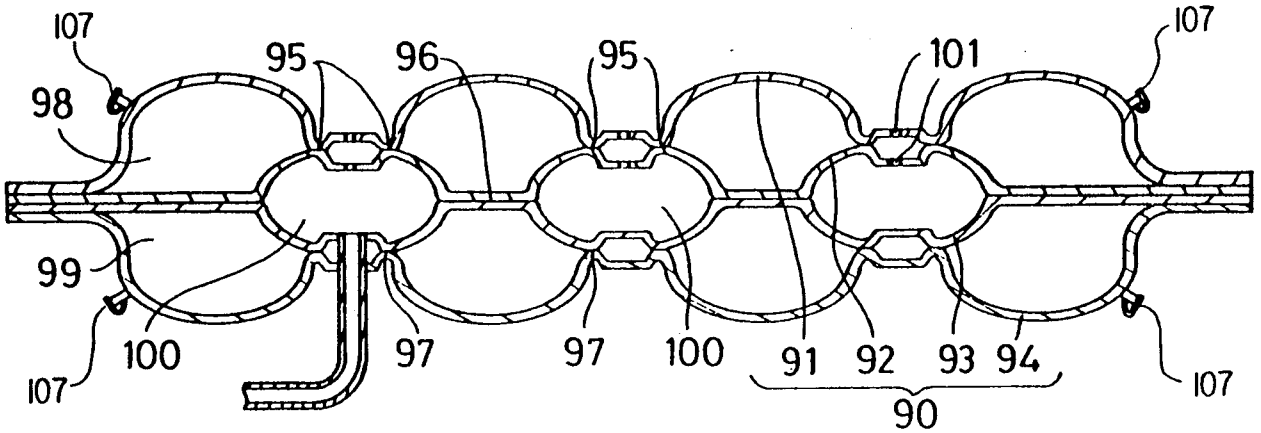

FIG. 5E shows an inflatable article 90 comprising a first layer of PVC sheet 91, a second layer of PVC sheet 92, a third layer of PVC sheet 93, and a fourth layer of PVC sheet 94. The first layer of PVC sheet 91 and the second layer of PVC sheet 92 are heat-sealed at a plurality of joints 95, the second layer of PVC sheet 92 and the third layer of PVC sheet 93 are heat-sealed at a plurality of joints 96, and the third layer of PVC sheet 93 and the fourth layer of PVC sheet 94 are heat-sealed at a plurality of joints 97, thus forming a plurality of upper air chambers 98 between the first layer of PVC sheet 91 and the second layer of PVC sheet 92, a plurality of lower air chambers 99 between the third layer of PVC sheet 93 and the fourth layer of PVC sheet 94, and a plurality of air passages 100 inclusive of vent holes 101 between the second layer of PVC sheet 92 and the third layer of PVC sheet 93.

Plugs 57, 67, 77, 87 and 107 permit air pressurization of upper and/or lower air chambers of the inflatable articles of FIGS. 5A through 5E, respectively, by blower 21 of the pressurized air supplying means 20, FIG. 1.

Figure 6:
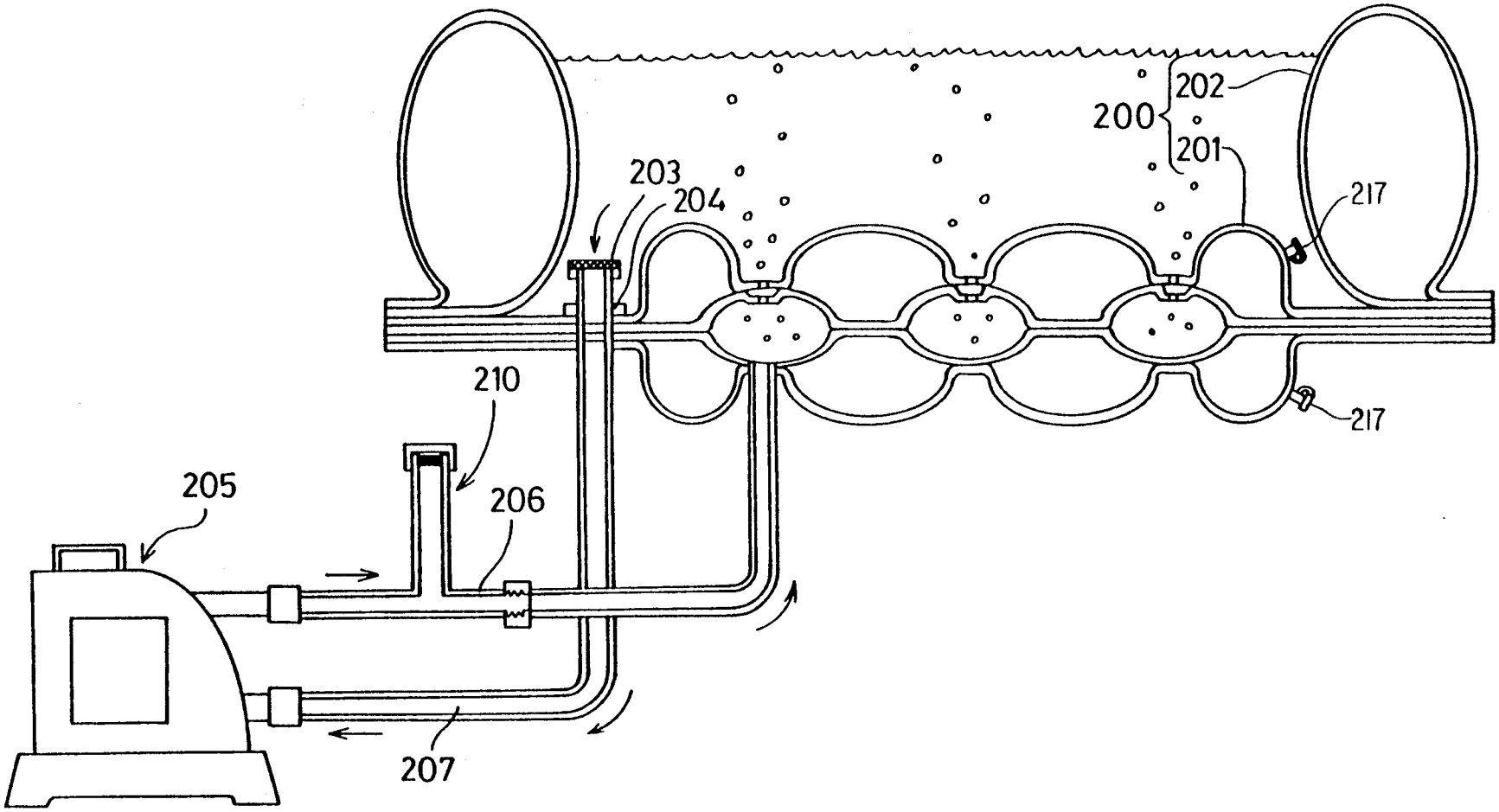
FIG. 6 is a sectional view of a tub utilizing the present invention as its base section, wherein water used in the tub is forced to recirculate through a filter and an air entrapping device for filtration and for bringing air bubbles into the water.
Figure 7:
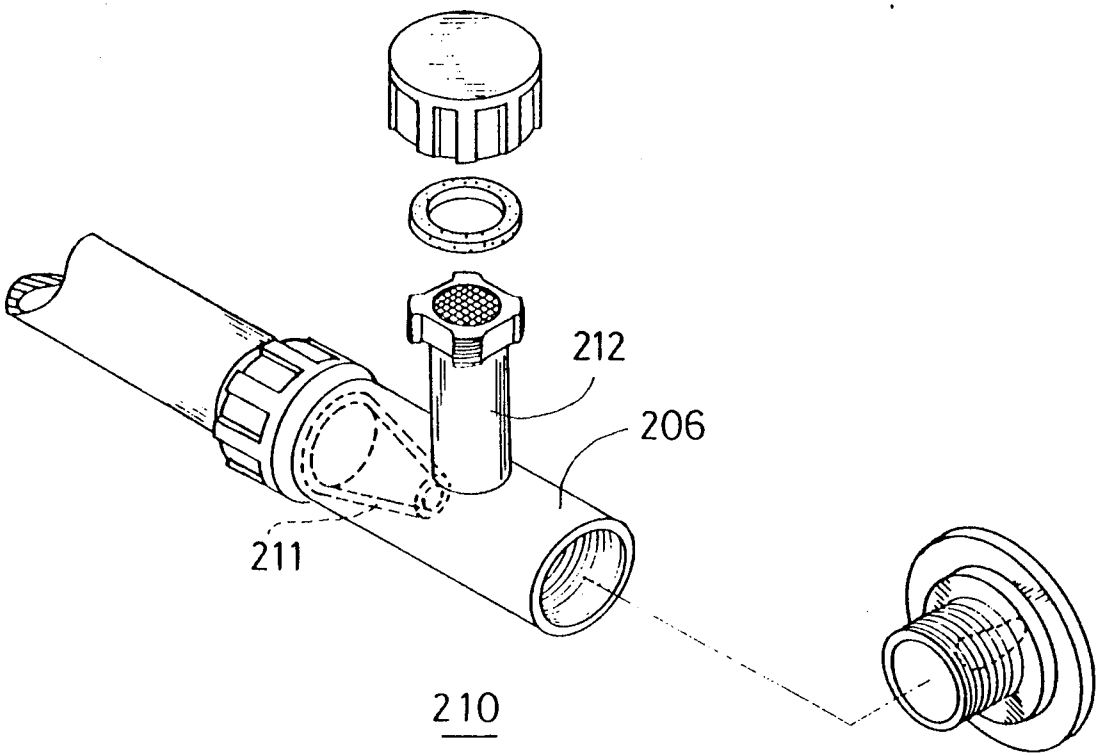
FIG. 7 is an enlarged perspective view of the air entrapping device shown in FIG. 6.

FIG. 6 is a sectional view of another construction type of the tub 1 in FIG. 1. This tub 200 includes an inflatable base section 201 and an inflatable surrounding section 202 heat-sealed to the circumference of base section 201, filter 203 mounted at a drain port 204 of base section 201, an outer recirculation pipe capable of being connected to the drain port 204, a water pump 205 installed intermediate the outer recirculation pipe by which water used in tub 200 is forced to recirculate through the outer recirculation pipe, and a pressurized air supplying means 205 installed in the outer recirculation pipe for bringing air bubbles into the recirculating water. The outer recirculation pipe includes a first pipe 207 interconnecting the intake port of pump 205 and tub 200, and a second pipe 206 interconnecting the exit port of pump 205 and tub 200. Since base section 201 has substantially the same construction as the inflatable article 90 shown in FIG. 5E, its description is omitted. As shown in FIG. 7, pressurized air supplying means or pump 205 feeds water under pressure through an aspirator or air entrapping device 210 mainly including a known conical venturi tube restrictor nozzle 211 provided within second pipe 206. A bypass pipe 212 is perpendicularly connected, at its one end, to the second pipe 206. Bypass pipe 212 provides air to the water exiting the venturi tube in pipe 206 by aspiration, when water flows through venturi tube 210. Accordingly, water used in tub 200 may be forced to recirculate through filter 203 for filtration purpose, and also through the aspirator or air entrapping device 210 for aspirating air into the water discharging from water pump 205 into line 206 so that air bubbles may be continuously carried into tub 200.

Air pressurization via pressurized air supply means 20, FIG. 1 of upper and lower air chambers is effected by opening closure plugs 217.

Figure 8:
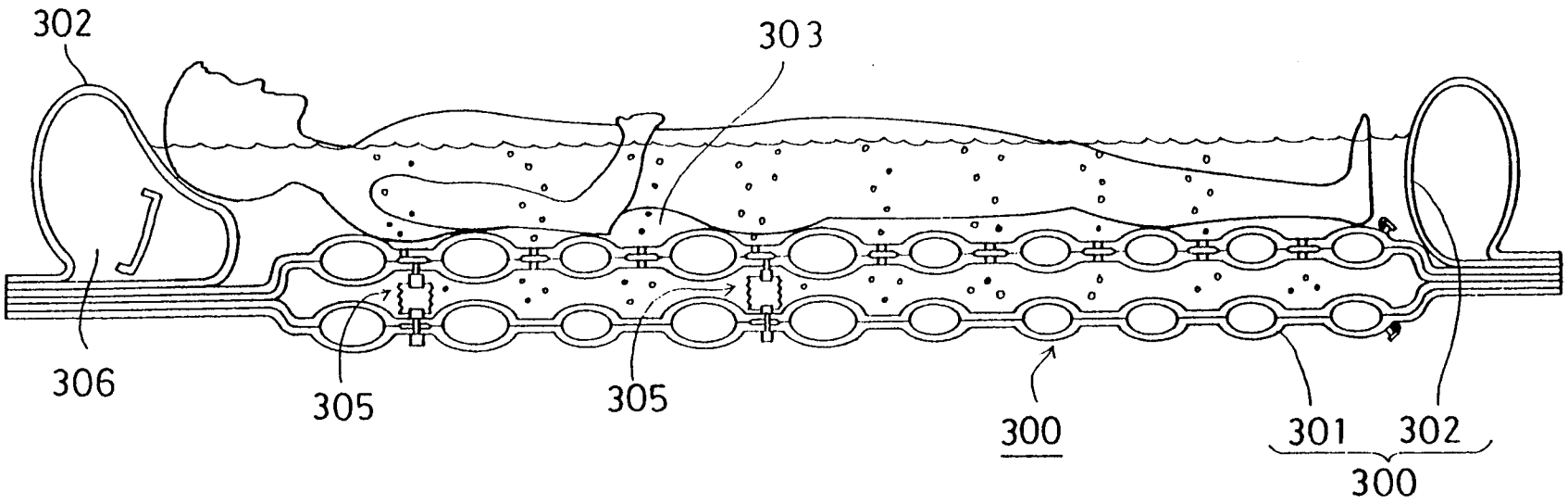
FIG. 8 is a sectional view of yet another type of tub utilizing the present invention as its base section, wherein air is automatically pumped into the tub under the action of the body of a user who keeps on moving downward to urge against and then upward to leave the base section of the tub alternately.

FIG. 8, shows a sectional view of yet another embodiment of a tub, different in construction from tub 1 in FIG. 1. This tub 300 includes an inflatable base section 301 and an inflatable surrounding section tube 302 heat-sealed to the periphery of the base section 301 so as to form a recess or cavity 303 for receiving water therein. The construction of this inflatable article is quite similar to that shown in FIG. 5D. However, instead of feeding air into the tub 300 by means of a blower, air is supplied into the tub 300 under the action of a user's body by use of self-acting pumping mechanisms 305 which will be explained below with references to FIGS. 8 and 9.

As can be seen in FIG. 8, self-acting pumping mechanisms 305 are provided between the second layer of PVC sheet 62 and the third layer of PVC sheet 63 at locations under the hip and/or shoulder blade of a user resting upon the base section 302 of the tub 301.

Figure 9:
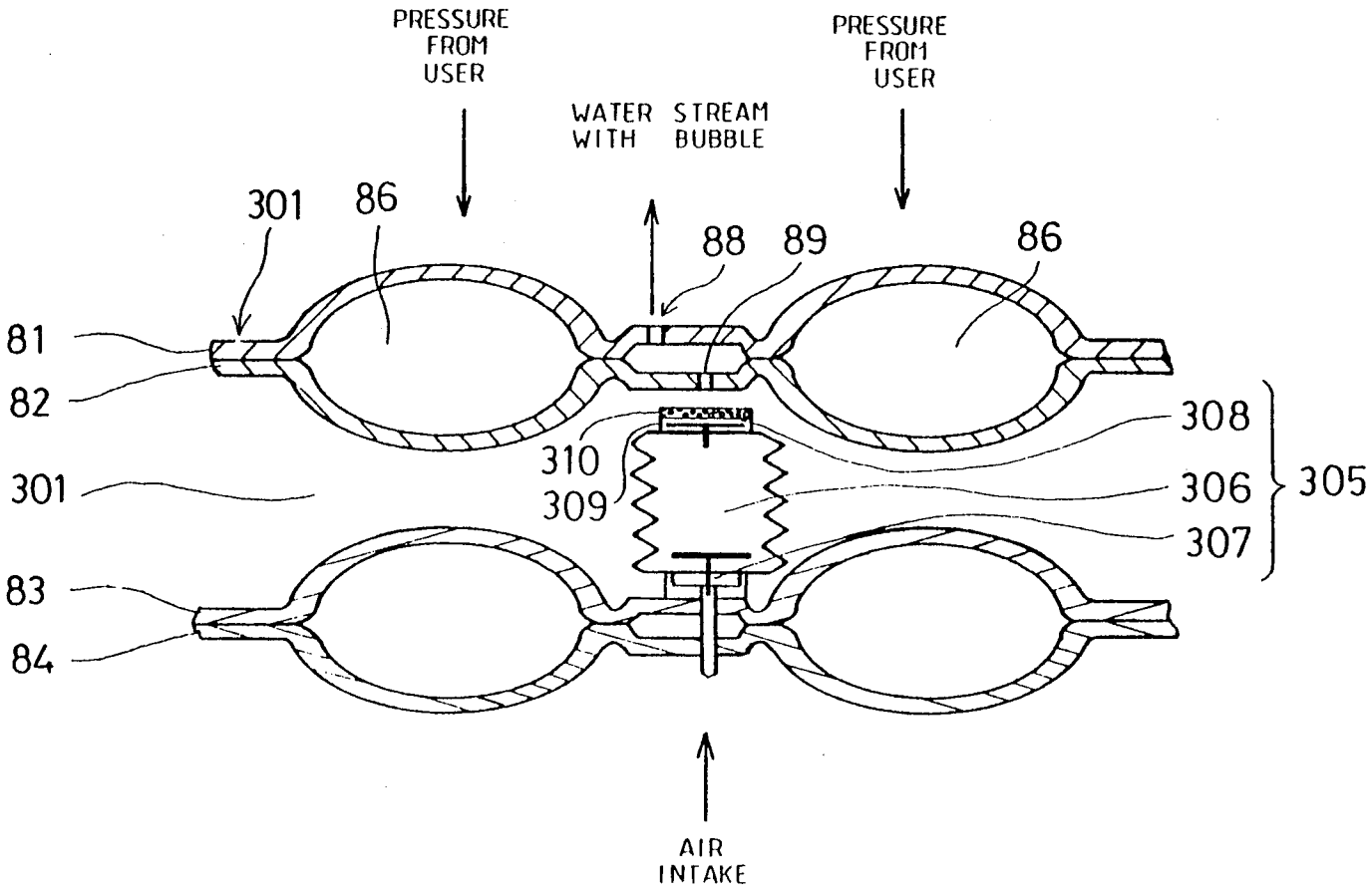
FIG. 9 is a fragmentary sectional view showing the pumping mechanism of the tub illustrated in FIG. 8.

The detailed construction of the self-acting pumping mechanism 305 is shown in FIG. 9. In this construction, water can flow into and fill up the space 302 between the second layer of PVC sheet 82 and the third layer of PVC sheet 83. As shown in this figure, each self-acting pumping mechanism 305 comprises a bellow-shaped compressible air storing chamber 306, a lower one-way valve 307 disposed at the inlet of the air storing chamber 306, and an upper one-way valve 308 disposed at the outlet of the air storing chamber 306. On the top of the air storing chamber there is provided a cover 309 having a plurality of apertures.

When the volume of air storing chamber is expanded, the lower one-way valve 307 allows air from the outside environment under base section 301 to flow into the air storing chamber 306, and the upper one-way valve 308 is closed. On the other hand, when the air storing chamber 306 is squeezed, the upper one-way valve 308 allows air inside the air storing chamber 306 only flow out and the lower one-way valve 307 is closed. The air thus squeezed out of the air storing chamber 306 will pass through the apertures 310 and mix with the water filling up the space 302.

Accordingly, when a user lies down upon the inflatable article, his/her weight will exert a pressure on the air storing chamber 305 as well as on the air chambers 86 such that air is squeezed out of the air storing chamber 305 and the water filling up the space 302 is spurted out to the water filling above the first layer of PVC sheet 81 along with the air. In this way, the user would enjoy the massage effects from a water stream accompanied with bubbles.

On the other hand, when downward pressure acting on the inflatable article by the user is released, the volume of the air storing chamber 306 will be expanded back to its normal size due to the elastic property of the bellow-shaped structure. Consequently, air is brought from the outside environment into the air storing chamber 306 through the one-way valve 307. Therefore, if the user repeats the action of lying down to apply a pressure on the inflatable article and then sitting up or standing up to release the pressure, such as doing a push-up or the like, air bubbles will be continuously supplied into the tub 300. Accordingly, by use of the above-described self-acting pumping mechanism 305, air bubbles can be brought into the water filling, the recess or cavity 303 of the tub 300 without utilizing any blower or any power source.

Figure 10A:
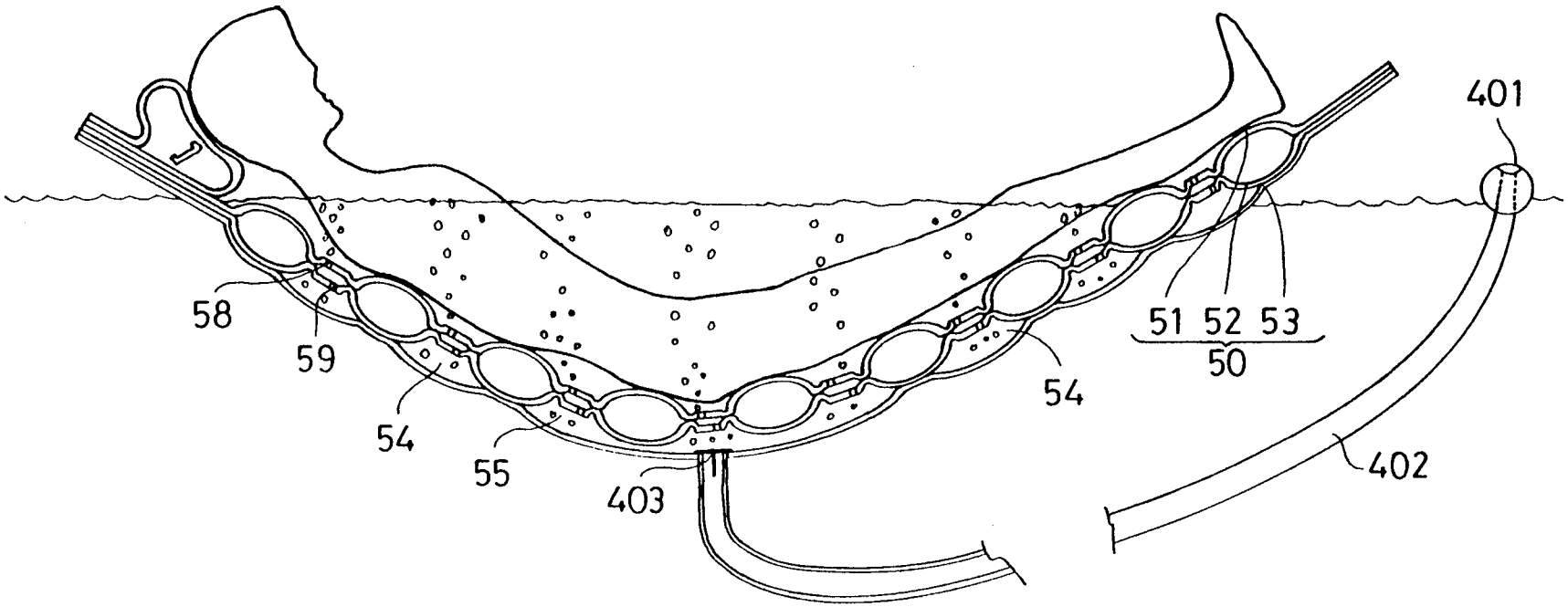
FIGS. 10A–10B are schematic side views of a person resting upon a floating mattress on water, FIG. 10A showing how the person exercises his/her waist down to let the inflatable article according to the present invention produce bubbles, and FIG. 10B showing the person rests flat upon the floating mattress.
Figure 10B:
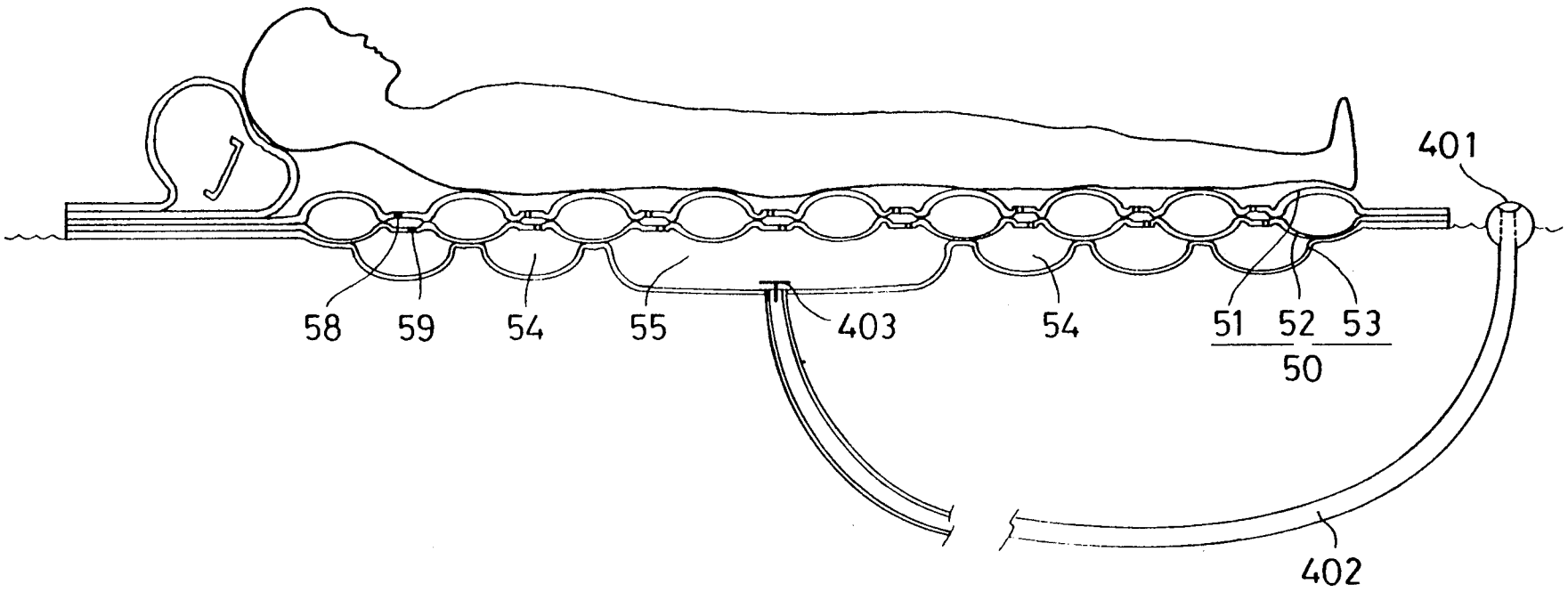

Referring to FIGS. 10A and 10B, in the second application the inflatable article according to the present invention is utilized as a floating mattress. A user generally uses the floating mattress to rest thereupon when taking a sun bath on the water of a swimming pool. Most of other available floating mattresses only let the user to rest thereon while the floating mattress utilizing the present invention is capable of generating massage bubbles for the user when it is stretched downwards and upwards.

The type of the inflatable article employed in FIGS. 10A and 10B is that shown in FIG. 5A. Numerals used in FIG. 5A are also used herein identically to indicate the same parts. The floating mattress includes a buoy 401 connecting via a hose 402 and a one-way valve 403 to an relative larger air chamber 55 located substantially at the center portion of the floating mattress. The user lying upon the floating mattress can exercise her/his body to a posture substantially as shown in FIG. 10A such that the center portion of the floating mattress is bent down and immersed into the water. The air inside the air chamber 55 thereby is squeezed out through the vent holes 58, 59 into the water and numerous bubbles are thus generated for the user. The air inside the air chamber 55 is supplied from the atmosphere by way of the buoy 401. As the user stretched his/her body back to a flat posture as shown in FIG. 10B, the air chamber 55 will restore to its normal size due to its elasticity, whereby air from the atmosphere will be sucked by way of the buoy 401 through the hose 402 into chamber 55 and again fill up the air chamber 55. The air chamber 55 can also be filled with an elastic porous material such as foam so as to facilitate the restoring of the squeezed air chamber 55 to its original shape more quickly. Therefore, if the user resting upon the floating mattress continues to move his/her waist upwards and downwards, massage bubbles would be unceasingly generated.

While the present invention has been described by way of preferred embodiments and practical applications, it is understood that various modifications to and different applications of the above preferred embodiments are possible to those who are skilled in the art. Therefore, the above mentioned different types of inflatable articles are intended to be illustrative rather than restricting the scope of the present invention.

What is claimed is:

1. An inflatable article for a user to rest thereupon, said inflatable article being capable of generating massage bubbles for said user when said inflatable article is immersed in water, comprising at least three layers of PVC sheets including a first layer of PVC sheet, a second layer of PVC sheet, and a third layer of PVC sheet, said second layer of PVC sheet being sandwiched between said first layer of PVC sheet and said third layer of PVC sheet and said first layer being in contact with the user when the user rests upon the inflatable article;

said first layer of PVC sheet and second layer of PVC sheet being heat-sealed together at a plurality of upper joints and along their peripheries so as to form at least one inflatable upper air chamber and at least one vent passage between said first layer of PVC sheet and said second layer of PVC sheet; said first and second layers including respectively upper and lower air vent holes offset from said at least one air chamber and communicating with each other by way of said at least one vent passage;

said second layer of PVC sheet and said third layer of PVC sheet being heat-sealed together at least along their peripheries so as to form, between said second layer of PVC sheet and said third layer of PVC sheet, at least one air passage, and means for connecting said air passage to a pressurized air supplying means for causing pressurizing air supplied by said pressurized air supplying means to enter said at least one air passage and pass through said upper and lower air vent holes, into the water in which the inflatable article is immersed beneath the user resting thereon; and means for permitting inflation of said at least one air chamber.

2. An inflatable article as claimed in claim 1, further comprising a fourth layer of PVC sheet heat-sealed to the underside of said third layer of PVC sheet along the peripheries of said third layer of PVC sheet and said fourth layer of PVC sheet.

3. An inflatable article as claimed in claim 2, wherein said third layer of PVC sheet and said fourth layer of PVC sheet are heat-sealed at a plurality of lower joints within their peripheries to form a plurality of lower air chambers.

4. An inflatable article as claimed in claim 1, wherein said upper and lower air vent holes are located in said first layer of PVC sheet and said second layer of PVC sheet at positions offset from each other, with a narrow clearance being formed between said first layer of PVC sheet and said second layer of PVC sheet by said at least one vent passage when pressurized air is being supplied so as to communicate said upper vent holes with said lower vent holes, said clearance being closed when pressurized air is not being supplied so as to prevent the water in which the inflatable article is immersed from entering into said air passage through said vent holes.

5. An inflatable article as claimed in claim 1, wherein each one of said upper air vent holes vertically aligns with a respective one of said lower air vent holes, thus making direct communication therebetween.

6. An inflatable article as claimed in claim 1, wherein said at least one inflatable upper air chamber comprises a plurality of separate upper air chambers, and wherein said second layer of PVC sheet and said third layer of PVC sheet are further heat-sealed together at a plurality of lower joints so as to form a plurality of connected air passages.

7. An inflatable article as claimed in claim 1, wherein said at least one upper air chamber comprises a plurality of upper air chambers and wherein said at least one air passage comprises a plurality of air passages, and said article further comprises:

at least one upper air compartment connecting all of said separate upper air chambers between said first layer of PVC sheet and said second layer of PVC sheet; and at least one lower air compartment connecting all of said plurality of air passages between said second layer of PVC sheet and said third layer of PVC sheet.

8. An inflatable article as claimed in claim 3, wherein said plurality of upper joints are separate from one another, and said plurality of lower joints are separate from one another.

9. An inflatable article as claimed in claim 1, wherein said pressurized air supplying means comprises an air blower.

10. An inflatable article as claimed in claim 1, further comprising:

an outer recirculation pipe connected at one end to said tub and at a second end to said air passage; and a pump, mounted intermediate said ends of said outer recirculation pipe for forcing the water in which the inflatable article is immersed to recirculate through said outer recirculation pipe;

wherein said pressurized air supplying means comprises an aspirator including a venturi tube installed within said outer recirculation pipe, and a bypass pipe connected, at one end, to said outer recirculation pipe in the vicinity of an exit of said venturi tube and opening to the environment at a second end for aspirating air through said bypass pipe into the recirculating water when water flows from said pump through said venturi tube.

11. An inflatable article as claimed in claim 1, wherein said second layer of PVC sheet and said third layer of PVC sheet are heat sealed at spaced positions to form a plurality of lower joints, and wherein said upper joints and said lower joints are annular joints and are separated from each other.

12. An inflatable article as claimed in claim 1, said at least one inflatable upper air chamber comprises a plurality of separate upper air chambers formed by laterally spaced, straight heat seal joints extending parallel to each other, thereby forming a plurality of parallel inflatable air chambers for supporting the weight of the user.

* * * * *